US006736342B2

(12) United States Patent
van Loo

(10) Patent No.: US 6,736,342 B2
(45) Date of Patent: May 18, 2004

(54) METHOD AND APPARATUS FOR COMMINUTING CHIPS

(75) Inventor: Joseph Hubert van Loo, Hoensbroek (NL)

(73) Assignee: Mayfran International B.V., Landgraaf (NL)

( * ) Notice: Subject to any disclaimer, the term of this patent is extended or adjusted under 35 U.S.C. 154(b) by 0 days.

(21) Appl. No.: 09/914,500

(22) PCT Filed: Feb. 14, 2001

(86) PCT No.: PCT/EP01/01620

§ 371 (c)(1),
(2), (4) Date: Aug. 29, 2001

(87) PCT Pub. No.: WO01/60522

PCT Pub. Date: Aug. 23, 2001

(65) Prior Publication Data

US 2002/0175234 A1 Nov. 28, 2002

(30) Foreign Application Priority Data

Feb. 15, 2000 (DE) ..... 100 06 757

(51) Int. Cl.[7] ..... B02C 25/00

(52) U.S. Cl. ..... 241/30; 241/36; 241/73; 241/82; 241/243; 241/285.3

(58) Field of Search ..... 241/242, 243, 241/36, 73, 30, 82, 285.3

(56) References Cited

U.S. PATENT DOCUMENTS

| | | | |
|---|---|---|---|
| 288,895 A | | 11/1883 | Wallace |
| 889,555 A | | 6/1908 | Stedman |
| 1,079,657 A | | 11/1913 | McLean |
| 1,647,730 A | * | 11/1927 | Hartman |
| 1,735,824 A | | 11/1929 | Huffman |
| 1,772,321 A | | 8/1930 | Ossing |
| 2,973,908 A | | 3/1961 | Danyluke |
| 3,096,035 A | | 7/1963 | Allen et al. |
| 3,220,658 A | | 11/1965 | Shelton |
| 3,343,800 A | | 9/1967 | Rasmussen |

(List continued on next page.)

FOREIGN PATENT DOCUMENTS

| | | |
|---|---|---|
| DE | G9418904 | 4/1995 |
| DE | 19641975 | 4/1998 |
| DE | 19703575 | 8/1998 |
| DE | 29907584 | 4/1999 |
| DE | 19923130 | 5/1999 |
| DE | 10006757 | 2/2000 |
| DE | 10012186 | 9/2001 |
| EP | 0 930 941 | 5/2000 |
| EP | 1 050 340 | 8/2000 |
| WO | WO 98/16318 | 4/1998 |
| WO | WO 00/45958 | 8/2000 |

OTHER PUBLICATIONS

Commercial Literature for Lindermann Rotorsheren.

*Primary Examiner*—Mark Rosenbaum
(74) *Attorney, Agent, or Firm*—Calfee, Halter & Griswold LLP

(57) ABSTRACT

A method and two apparatuses for comminuting chips are presented. Chip breakers without a coarse-part ejecting element are often used for comminuting chips. Blocking constituents therefore have to be removed with great effort, for example by hand. If a coarse-part ejecting element is present, there is no differentiation between blocking hard parts and blocking clumps of chips, but instead both types are ejected. It is now envisaged to subdivide blocking constituents in horizontal chip breakers into categories, depending on the negative acceleration of the shaft (3, 17, 18) caused by the blocking, and to assign to each category a defined reversing operation for loosening the blocking constituents and, if appropriate, discharge from the comminuting space (1, 15) by means of a coarse-part ejecting element (12, 32).

24 Claims, 8 Drawing Sheets

Figure 1:
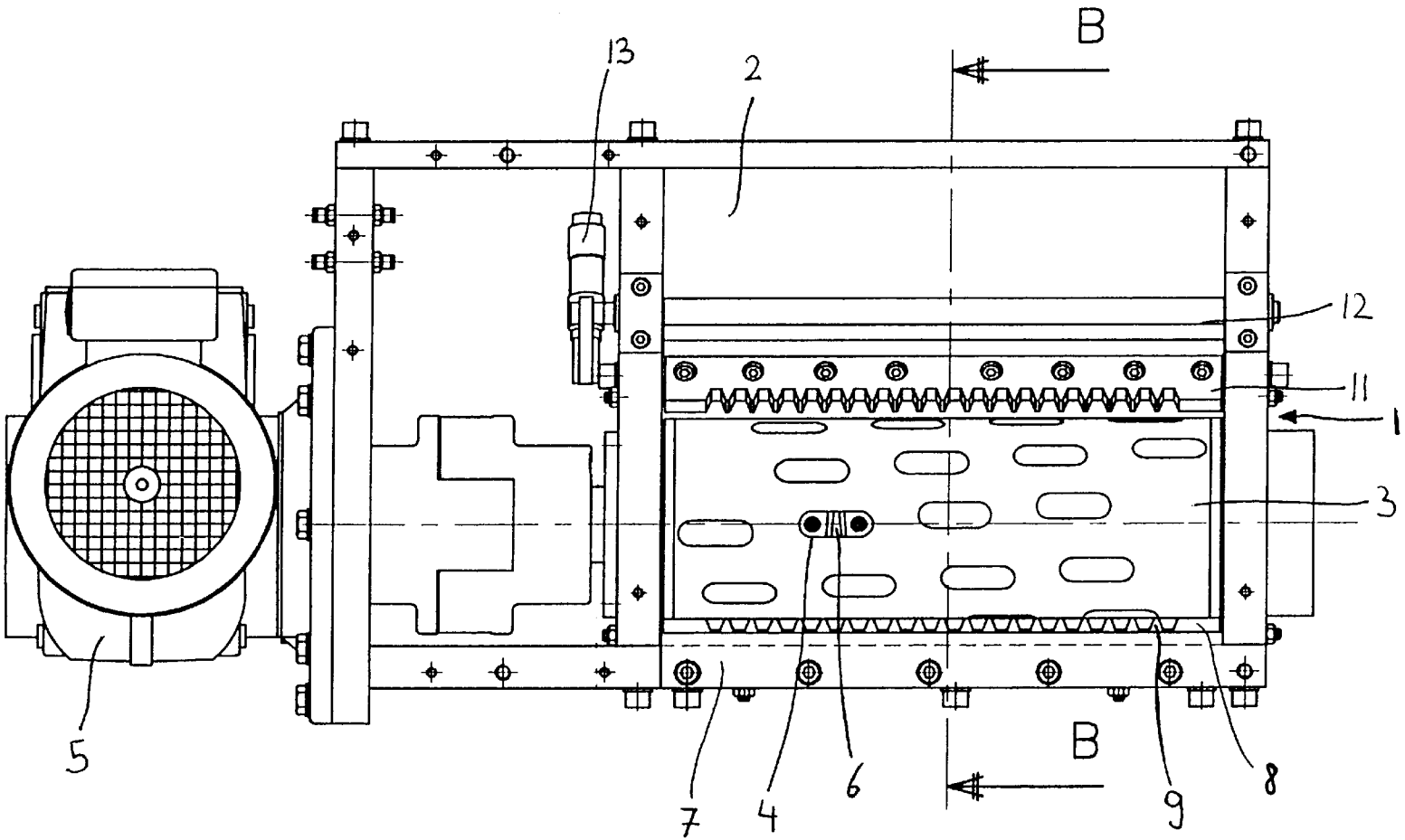

U.S. PATENT DOCUMENTS 3,703,970 A 11/1972 Benson
3,873,035 A 3/1975 Benson
4,166,583 A 9/1979 Ruckstuhl
4,351,485 A 9/1982 Hardwick et al.
4,377,259 A 3/1983 Areaux et al.
4,418,872 A 12/1983 Nelson
4,423,844 A 1/1984 Sours et al.
4,449,673 A 5/1984 Cameron
4,529,134 A 7/1985 Williams
4,609,155 A 9/1986 Garnier
4,690,337 A 9/1987 Stiefel
4,793,561 A 12/1988 Burda
4,813,620 A 3/1989 Engelmohr et al.
4,917,310 A 4/1990 Carrera
5,044,567 A * 9/1991 Hausler et al.
5,150,844 A 9/1992 McKie
5,213,273 A 5/1993 Linnerz
5,248,100 A * 9/1993 Arakawa ..... 241/34
5,273,218 A 12/1993 Burns
5,484,110 A 1/1996 Doppstadt
5,503,339 A 4/1996 Doppstadt
5,505,393 A 4/1996 Serban et al.
5,595,348 A 1/1997 Barone
5,743,472 A 4/1998 Williams, Jr. et al.
5,785,261 A 7/1998 Lanner
5,829,690 A 11/1998 Deschamps
5,863,003 A 1/1999 Smith
6,283,305 B1 9/2001 Maeda et al.

* cited by examiner 30
34
28
19
17
24
16
19'
18
32

METHOD AND APPARATUS FOR COMMINUTING CHIPS

DESCRIPTION

The invention relates to a method for comminuting chips in a comminuting space between a driven horizontal shaft, which can be rotated in both directions and is fitted with shearing elements, and assigned counter-shearing elements, with chips introduced from above being comminuted and discharged downwards via a perforated screening plate and blocking constituents, which cause the shaft to come to a standstill, being segregated after reversing the shaft. The invention also relates to two apparatuses for carrying out the method according to the invention.

The comminuting of chips in horizontal chip breakers is known from DE 94 18 904 U1. In this case, chips which are generated during the machining of workpieces made of metal, plastic or wood are comminuted in a comminuting space between two electrically driven shafts, the shearing cutters of which engage in one another during rotation, and are discharged via a perforated plate. If a coarse part becomes lodged between the two shafts, and consequently causes a standstill of the shafts, the shafts can be moved in the opposite direction of rotation by means of a corresponding controller. A blocking coarse part can then generally be removed by hand or magnetic parts can be removed by magnets from the comminuting space. Each time coarse parts are removed, standstills and consequently reduced throughput rates occur. Moreover, the use of personnel is necessary for this.

A vertical chip breaker for steel or metal chips with a coarse-part ejecting element is known from EP 0 717 663 B1. This single-shaft breaker comprises a receiving hopper and a downwardly adjoining grinding hopper with circumferentially distributed tearing blocks, past the tearing edges of which the tearing cutters attached to a rotating cutter head can be moved. Underneath the grinding hopper there adjoins a grinding mechanism. Provided in the lower region of the grinding hopper is a discharge channel for coarse parts, which can be opened by means of a powered channel slide. If there is a coarse part among the chip material, it lies on the grinding mechanism and is moved by the cutter head together with the chips in a rotating manner until blocking of the cutter head occurs. To eliminate the blockage, a slow reversing operation is initiated and the coarse-part ejecting element is opened, in order that the disruptive elements can be transported from the cutter head towards the discharge and through the latter.

A disadvantage of this configuration is that it cannot be used for horizontal chip breakers. Furthermore, if there is an impairment of the rotational movement of the cutter head, there is no differentiation here between dense clumps of chips and coarse parts or combinations of the two. Experience has shown that dense clumps of chips can also often lead to a blockage. These clumps are likewise removed here via the discharge and are consequently extracted from the comminuting operation.

The object of the present invention is consequently to provide a method and two apparatuses of the type mentioned at the beginning, including a horizontal chip breaker which differentiates the blocking constituents according to groups, for example dense clumps of chips or purely coarse parts, and assigns to each group a defined reversing operation and, if appropriate, discharge from the comminuting space by means of a coarse-part ejecting element.

To achieve the object, the invention provides a method in which the rate of change of the loading of the driven shaft fitted with shearing elements is sensed, the presence of blocking constituents being established on the basis of the sensed rate of change of the loading while taking into account the type, quantity and/or size of chip, and then the non-comminuted blocking constituents being ejected after one or more reversals of the shaft. When sensing the rate of change of the loading of the shaft fitted with shearing elements due to blocking constituents it is found that each type of constituent brings about a different rate of change of the loading. Hard, one-piece coarse parts, for example fragments of machined workpieces, produce a high rate of change of the loading. Very dense clumps of chips bring about a lower rate of change of the loading. For less dense clumps of chips, the value is lower still. At the same time, the various chip parameters have to be taken into account, since chips break more or less easily, depending for example on the material from which they are produced. If there is an operational disruption as a result of a blocking part, it can be automatically discharged by means of a coarse-part ejecting element by one or more reversing operations. Intervention by the operator is not necessary. The comminuting operation is continued again after the removal. For configurations in which the counter-shearing elements are attached on a second shaft, it may be advantageous to program the controllers of the shaft and countershaft in such a way that during the reversing operation one shaft is stationary or is reversed much more slowly than the other shaft. This counteracts any throwing out of the previously blocking constituents. Furthermore, it is more probable in such a sequence of movements that the blocking constituents are taken along by the faster shaft, and consequently are taken to the same side of the comminuting space.

The method according to the invention may be carried out in an advantageous way by sensing the acceleration of the shaft to sense the rate of change of the loading of the driven shaft fitted with shearing elements. Hard, one-piece coarse parts, for example fragments of machined workpieces, produce a high negative acceleration. Very dense clumps of chips bring about a lower negative acceleration. For less dense clumps of chips, the value is lower still. It goes without saying that the rate of change of the loading can also be sensed for example via the change in torque of the shaft by means of strain gauges. Depending on the load, in this case the rate of speed of deformation of the shaft would vary. Vibration-measuring instruments are also conceivable, since a blockage due to coarse parts would cause greater vibration than dense clumps of chips.

The method according to the invention may be carried out in such a way that, on the basis of the established acceleration profile, the constituents causing a blockage are subdivided into at least two categories, the constituents being moved more or less frequently by reversing of the shaft, and either passed on in a comminuted state or thrown back in an uncomminuted state, according to the relevant category.

Subdivision into categories allows an optimized program sequence to be devised for each type of constituent in the case of blocking constituents. For instance, compacted clumps of chips which cause blocking can be recognized as such on the basis of the relatively low negative acceleration caused by them. Sustained repeated reversing with a closed coarse-part ejecting element may follow, intended to comminute the compacted clump of chips. At the end of the reversing operation, however, still existing dense remains of clumps can be discharged by means of the openable coarse-part ejecting element. Blocking coarse parts form another category. Coarse parts may be, for example, fragments of machined workpieces or screws. These coarse parts abruptly bring about a high negative acceleration when there is a blockage. Since it is not possible for constituents of this type to be comminuted by the shearing elements, a short reversing operation with the coarse-part ejecting element open is initiated in order to eject the coarse part as quickly as possible.

It may be advantageous in the case of the method according to the invention to arrange the categories according to increasing negative acceleration, the frequency of reversal decreasing from category to category with increasing negative acceleration. The more solid a blocking constituent is, the higher the negative acceleration in the case of a blockage and the lower the probability of this constituent being comminuted by frequent reversal and of the blockage being ended. It is therefore advisable in the case of solid objects to end the blockage by reversing briefly and subsequently segregating the constituent by means of the coarse-part ejecting element, so that the chip comminution can be continued without delay.

The method according to the invention may also be advantageously carried out in such a way that the change in rotational speed of the drive is measured for sensing a negative shaft acceleration. By sensing the negative shaft acceleration via the change in speed of the drive, there is no need for direct sensing at the shaft. Sensing at the shaft could only be accomplished with great effort. For example, a sensor would have to be protected against becoming soiled by chip dusts adhering to it or penetrating into the housing. An optical sensor could not be used on account of the chips to be comminuted.

Finally, the method according to the invention may also be carried out in such a way that the rotational speed is set to be lower during the reversing of the shaft than the normal rotational speed. Reducing the speed during reversing prevents blocking constituents from being dislodged abruptly and thrown about in the comminuting space. Instead of this, the intention is for the blocking constituent to be carefully dislodged and taken beyond the shaft to the coarse-part ejecting element by reversing.

In the case of a first apparatus for comminuting chips which is equipped with a horizontal shaft which is arranged in a comminuting space, can be rotated in both directions by means of a drive and controller and is fitted with shearing elements, with counter-shearing elements assigned to this shaft and with a curved perforated screening plate adapted to the shape of the shaft, the object stated above is achieved by an openable coarse-part ejecting element being attached to the walls of the comminuting space lying parallel to the shaft axis and by the counter-shearing elements being arranged in two rows on walls of the comminuting space lying parallel to the shaft axis. Furthermore, a controller for the coarse-part ejecting element is provided, the controllers of the shaft and coarse-part ejecting element being linked with each other. For sensing the rate of change of the loading of the shaft, a controller for the coarse-part ejecting element is provided, sensing the negative accelerations of the shaft, and, depending on the respective negative acceleration, a variable number of reversing operations with the coarse-part ejecting element closed and/or open can be programmed.

The first apparatus according to the invention, i.e. the horizontal single-shaft breaker, makes it possible for the comminuting operation to proceed with virtually no friction. A separation of hard parts and chips takes place. Any discharge of chips via the coarse-part ejecting element is avoided to the greatest extent. The standstill times become shorter and wearing of the shearing elements is reduced. The apparatus operates automatically, which reduces the demand for labour. The apparatus can be produced simply and inexpensively. It is possible to retrofit existing breakers correspondingly, or in the production of new breakers to fall back on already existing modules to the greatest extent. For instance, it is conceivable for a simple flap which can be opened outwards to be used as the coarse-part ejecting element. However, it may also be a door to be pushed to the side.

It may be advantageous to design the first apparatus according to the invention in such a way that the negative accelerations of the shaft can be determined by sensing measured values at the drive. The drive of a chip breaker is normally arranged outside the chip breaker, so that a measuring device can be accommodated there in a dustfree environment and can be serviced easily.

It may be advantageous to design the first apparatus according to the invention in such a way that one of the shearing rows lies at the height of the shaft axis or lower, i.e. underneath the opening of the coarse-part ejecting element, and the other shearing row is arranged on the opposite wall above the shaft axis. If a constituent becomes lodged between the lower shearing row and the shaft, reversing once can loosen this constituent and move it directly to the opening in the wall, whereby it leaves the comminuting space. On the opposite side, the shearing row should be attached at a higher level, in order that a blocking constituent which has to be transported to the coarse-part ejecting element can be transported more easily beyond the shaft.

Furthermore, it may be advantageous to design the first apparatus according to the invention in such a way that the lower-lying shearing row is the lower limitation of the coarse-part ejecting element. Such an embodiment has the effect that a blocking constituent is already as close as possible to the coarse-part ejecting element. Brief reversing is sufficient to loosen this constituent and segregate it immediately.

The first apparatus according to the invention may be advantageously designed in such a way that the shearing rows are mounted on the walls with a slope towards the coarse-part ejecting element. Such a slope facilitates the transport of blocking constituents to the coarse-part ejecting element and through it during reversing.

In the case of a second apparatus for comminuting chips which is equipped with a horizontal shaft which is arranged in a comminuting space, can be rotated in both directions by means of a drive and controller and is fitted with shearing elements and with counter-shearing elements arranged on an assigned countershaft of the same kind and with a perforated screening plate curved to match the shaft and countershaft, the object stated above is achieved by an openable coarse-part ejecting element being attached to at least one of the walls of the comminuting space lying parallel to the shaft axis. Furthermore, for sensing the rate of change of the loading of the driven shaft(s), a controller for the coarse-part ejecting element is provided, sensing the negative accelerations of at least one of the shafts, the controllers of the shaft, countershaft and coarse-part ejecting element being linked with each other; at the same time, depending on the respective negative acceleration, a variable number of reversing operations with the coarse-part ejecting element closed and/or open can be programmed.

The second apparatus according to the invention, i.e. the horizontal twin-shaft breaker, makes it possible for the comminuting operation to proceed with no friction. In precisely the same way as in the case of the first apparatus according to the invention, i.e. the single-shaft breaker, a virtually complete separation of hard parts and chips takes place, any discharge of chips via the coarse-part ejecting element being avoided to the greatest extent. The standstill times become shorter and wearing of the shearing shafts is reduced. This apparatus also operates automatically and can be produced simply and inexpensively. It is possible to retrofit existing twin-shaft breakers correspondingly, or in the production of new breakers to fall back on already existing modules to the greatest extent. One or two coarse-part ejecting elements may be provided, for example in the form of flaps or sliding doors.

It may be advantageous to design the second apparatus according to the invention, i.e. the twin-shaft chip breaker, in such a way that the negative accelerations of at least one of the shafts can be determined by sensing measured values at the drive. The drive of a chip breaker is normally arranged outside the chip breaker, so that a measuring device can be accommodated there in a dustfree environment and can be serviced easily.

It may be advantageous to design the second apparatus according to the invention, i.e. the twin-shaft chip breaker, in such a way that the shaft is mounted at a higher level than the countershaft and a coarse-part ejecting element is attached on the wall facing the countershaft. The higher-level mounting of the shaft has the effect that the previously blocking constituents are more likely to be carried by the lower-mounted countershaft to the coarse-part ejecting element. This reduces the number of reversals required, and also makes it possible to dispense with a second coarse-part ejecting element.

Furthermore, it may be advantageous to design both apparatuses according to the invention, i.e. the single-shaft and twin-shaft breakers, in such a way that the apparatus is set up with an angle of inclination about one or two axes. In this case, it may also be advantageous that the one angle of inclination or both angles of inclination can be individually set. In one embodiment, in which for example the axis of rotation of the inclination is formed parallel to the axes of rotation of the shafts, the ejecting of coarse parts can be facilitated significantly by an oblique position of the apparatus towards the coarse-part ejecting element.

Furthermore, it may be advantageous for both apparatuses according to the invention to fasten the shearing elements and/or counter-shearing elements individually on the shaft. During the comminution of chips, there is irregular wearing of the (counter-) shearing elements. Some (counter-) shearing elements are worn away more quickly than others. These (counter-) shearing elements can then be removed and renewed individually.

It may also be advantageous for both apparatuses according to the invention to form the shearing elements and/or counter-shearing elements on a shaft differently. For instance, a shaft, or both shafts, may be fitted with differently sharp (counter-) shearing elements. The sharper (counter-) shearing elements may be arranged at the regions of greater stress. In the case of an arrangement with a shaft axis inclined slightly in the direction of gravitation, it is advisable for example to fit increasingly sharper (counter-) shearing elements from the higher end of the shaft to the lower end of the shaft.

Both apparatuses may be advantageously equipped with a drive in the form of an electric motor or hydraulic motor.

If they are provided with an electric motor, to sense the negative shaft acceleration it may be advantageous for both apparatuses to provide a pulse pickup for measuring the rotational speed at the electric motor. In this case, a signal disc, in the form of a rotor, with a proximity switch may be used as the pulse pickup. By sensing the negative shaft acceleration via the change in rotational speed of the drive, there is no need for direct registration at the shaft, which could also only be accomplished with great effort.

Furthermore, if they are provided with an electric motor, it may be advantageous for both apparatuses to measure the negative shaft acceleration via the increase in current.

If they are provided with a hydraulic motor, it may also be advantageous for both apparatuses to sense the negative shaft acceleration via a volumetric flow measurement or rotational speed measurement.

Furthermore, it may be advantageous to design the apparatuses according to the invention in such a way that the coarse-part ejecting element is equipped with a sensor for sensing passing coarse parts. In this case, the sensor may be an optical sensor. If a constituent passes the coarse-part ejecting element, directly after that the coarse-part ejecting element is closed and the reversing operation is ended.

The apparatuses according to the invention may be advantageously designed in such a way that the coarse-part ejecting element is a flap which can be opened by means of pneumatics or hydraulics. Flaps operated in this way are already known from and successfully proven in other areas. An ejecting element in the form of a flap can be produced simply and at low cost. This embodiment is also robust enough with respect to the daily demands of the comminuting operation.

Advantageous embodiments of the method according to the invention and of the horizontal single-shaft and twin-shaft breakers according to the invention are presented below on the basis of several figures, in which:

FIG. 1 shows a schematic plan view of a single-shaft chip breaker

Figure 2:
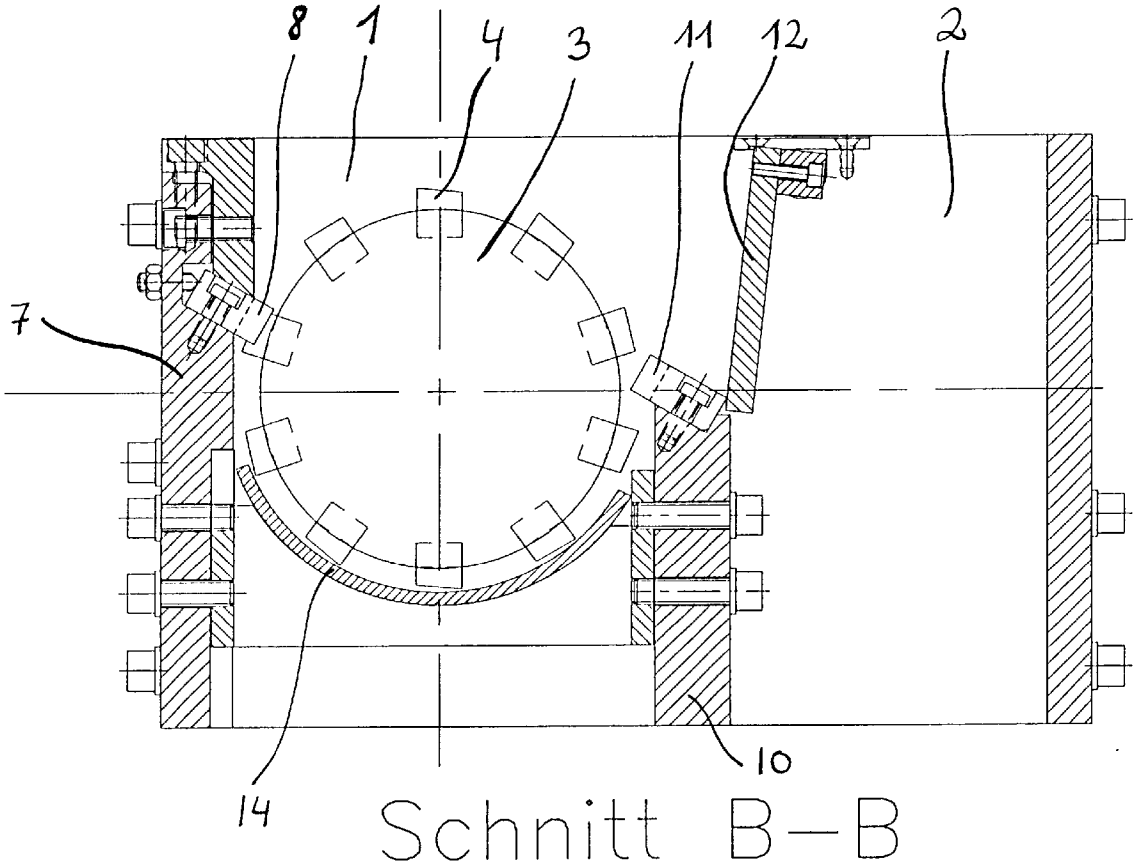
Figure 3:
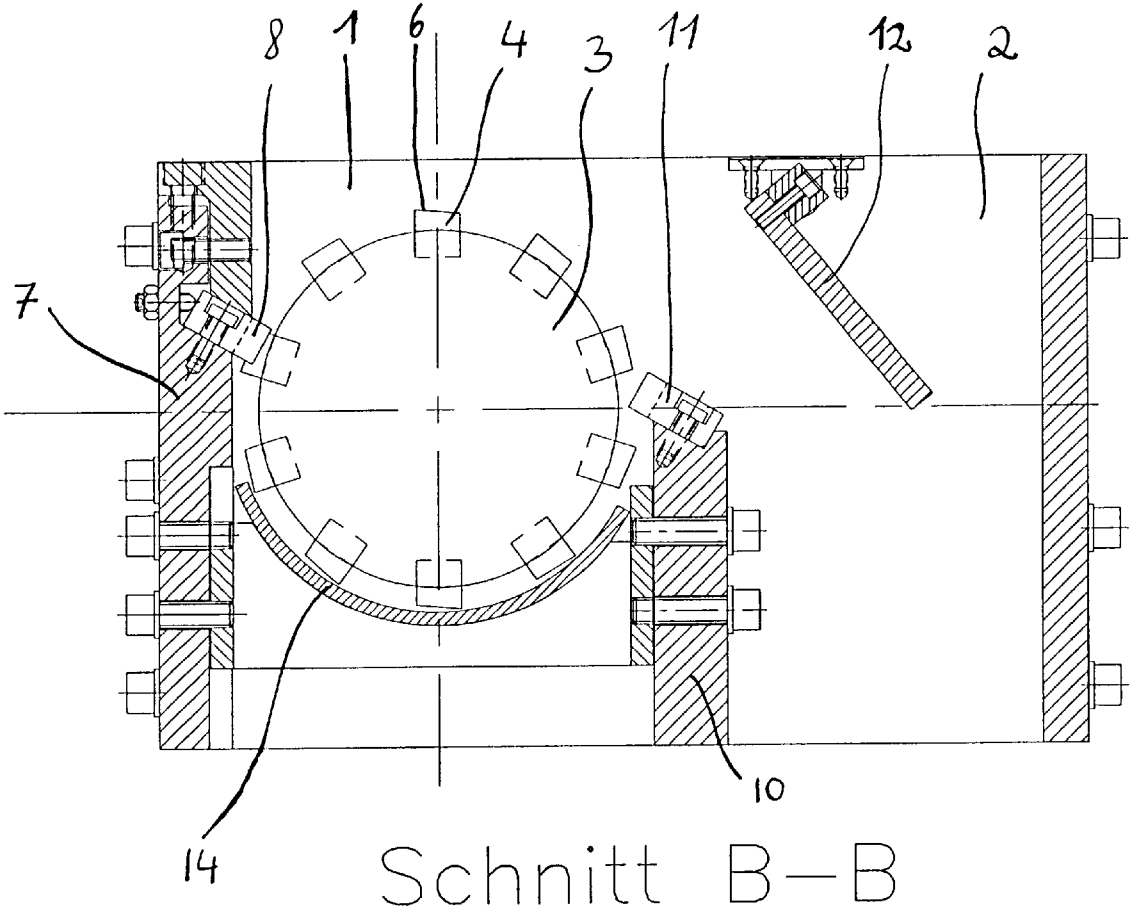
Figure 4:
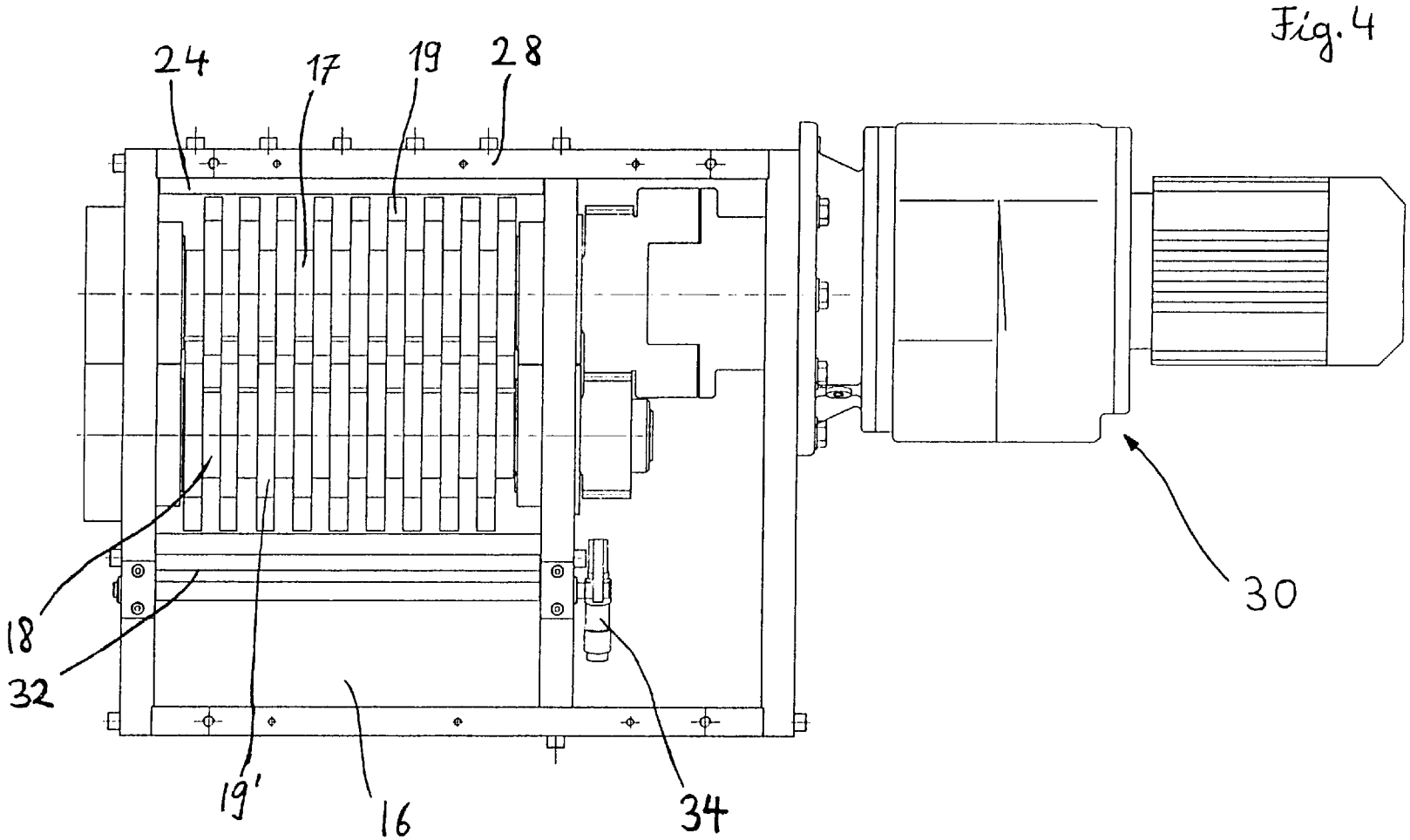
Figure 5:
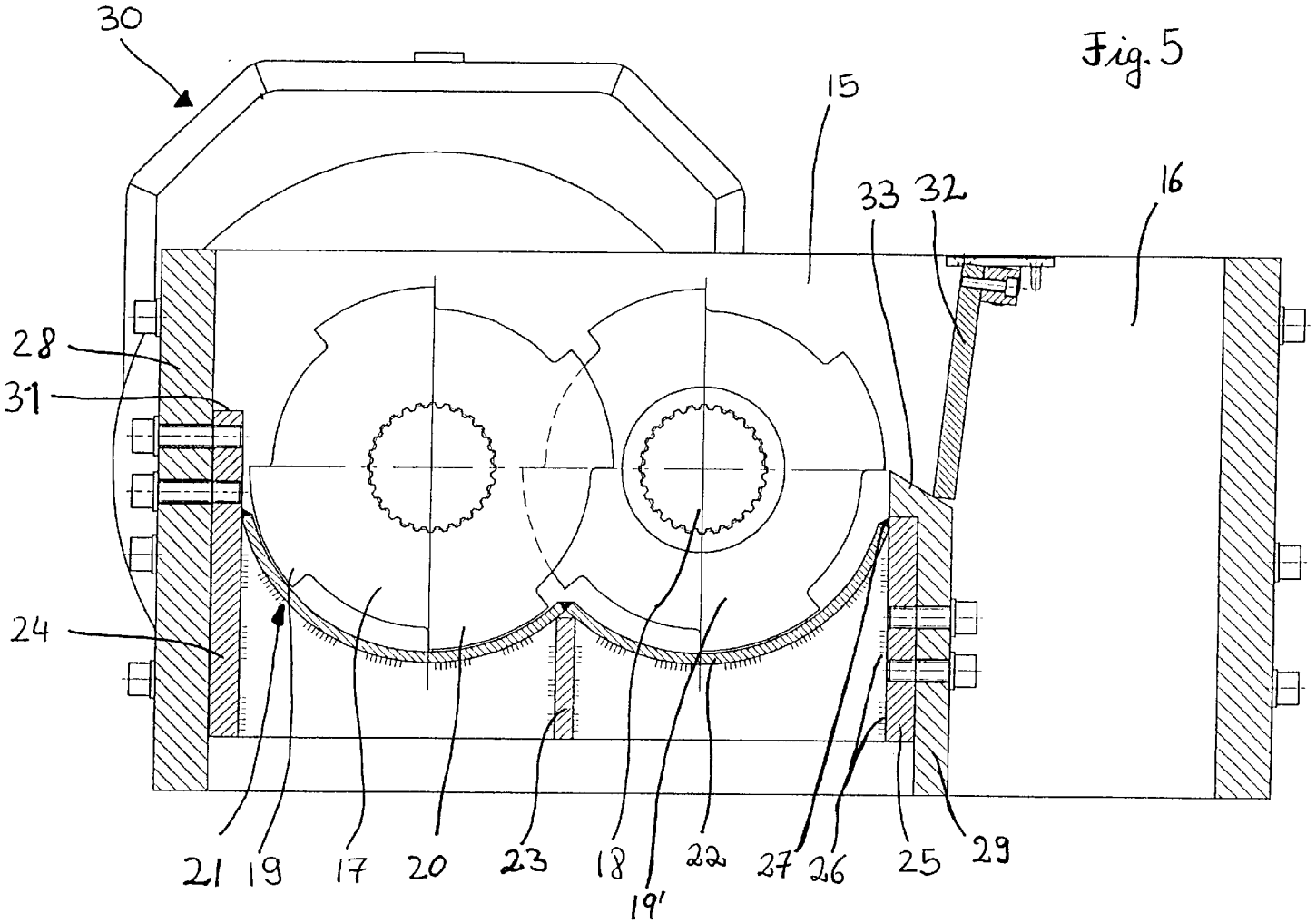
Figure 6:
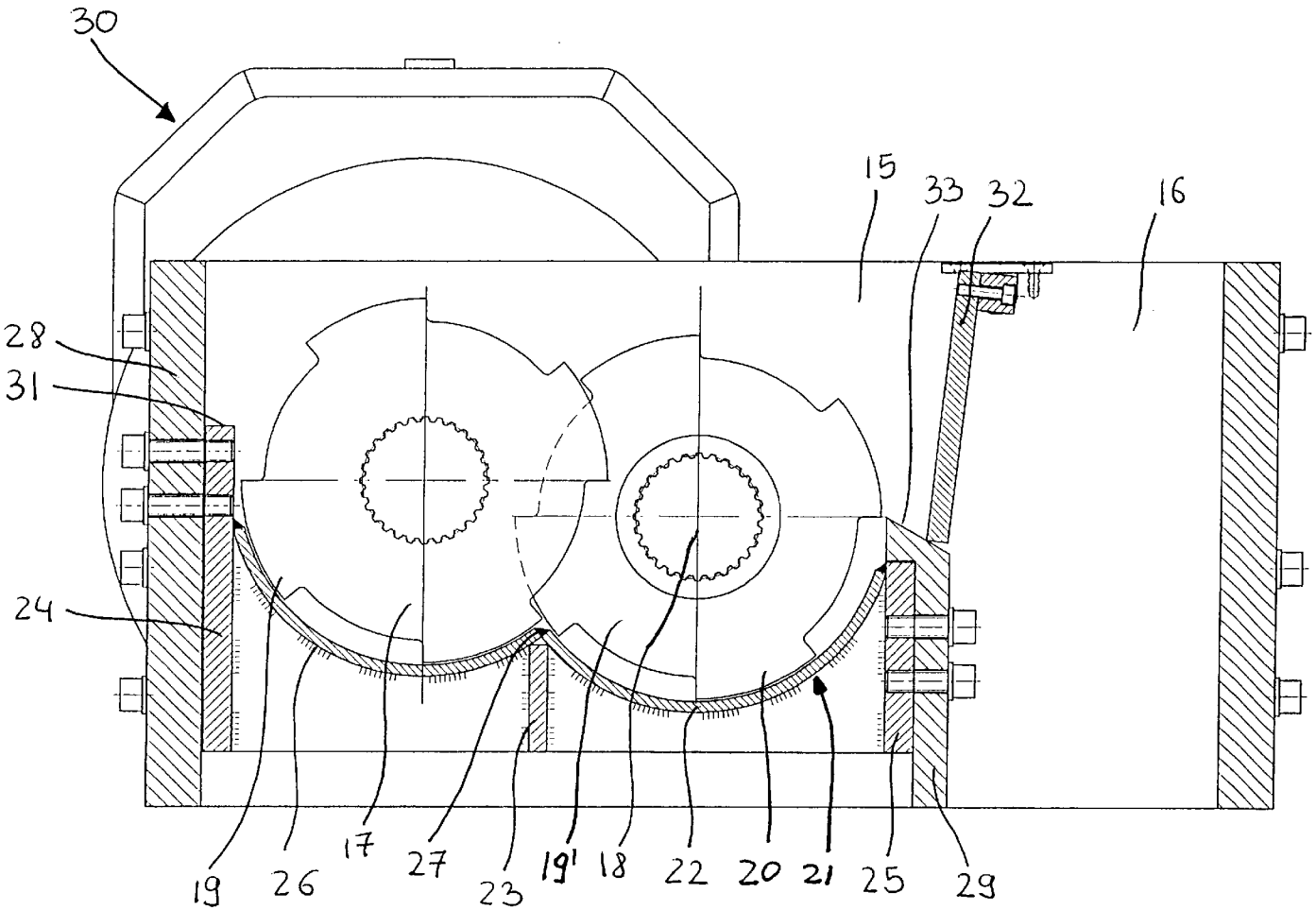
Figure 7:
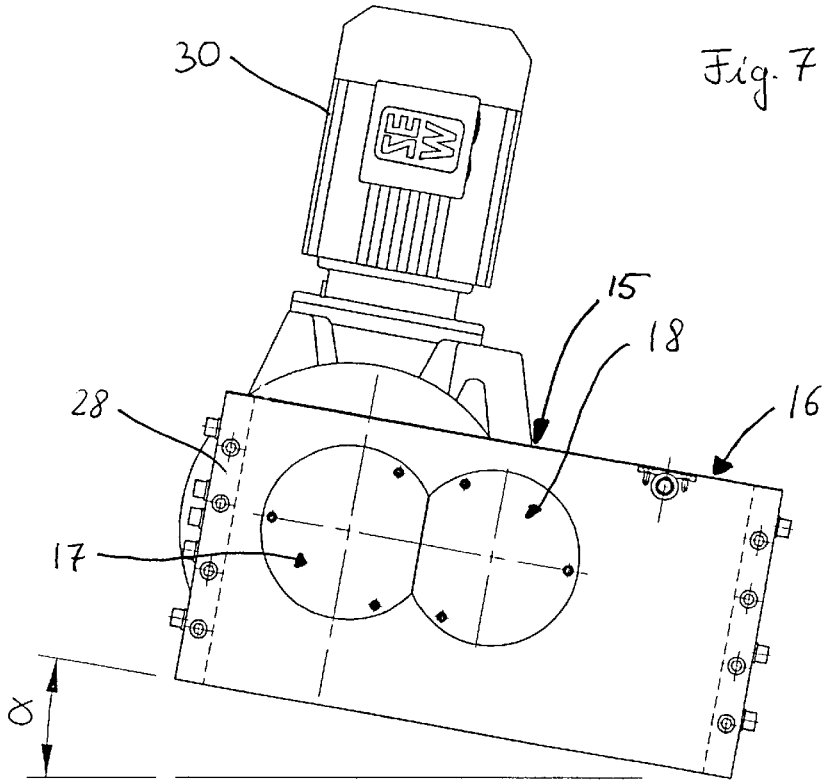
Figure 8:
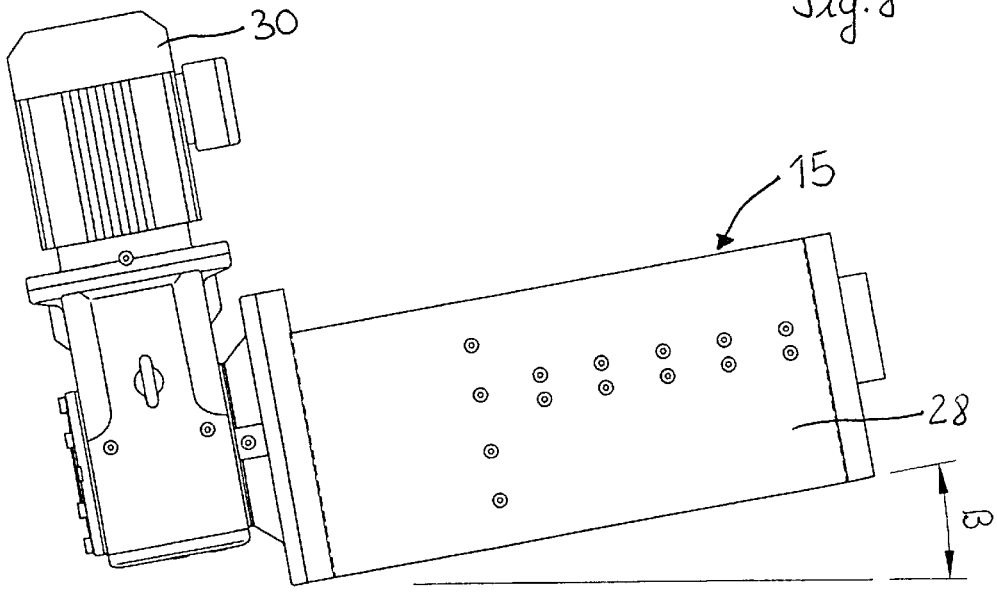
Figure 9:
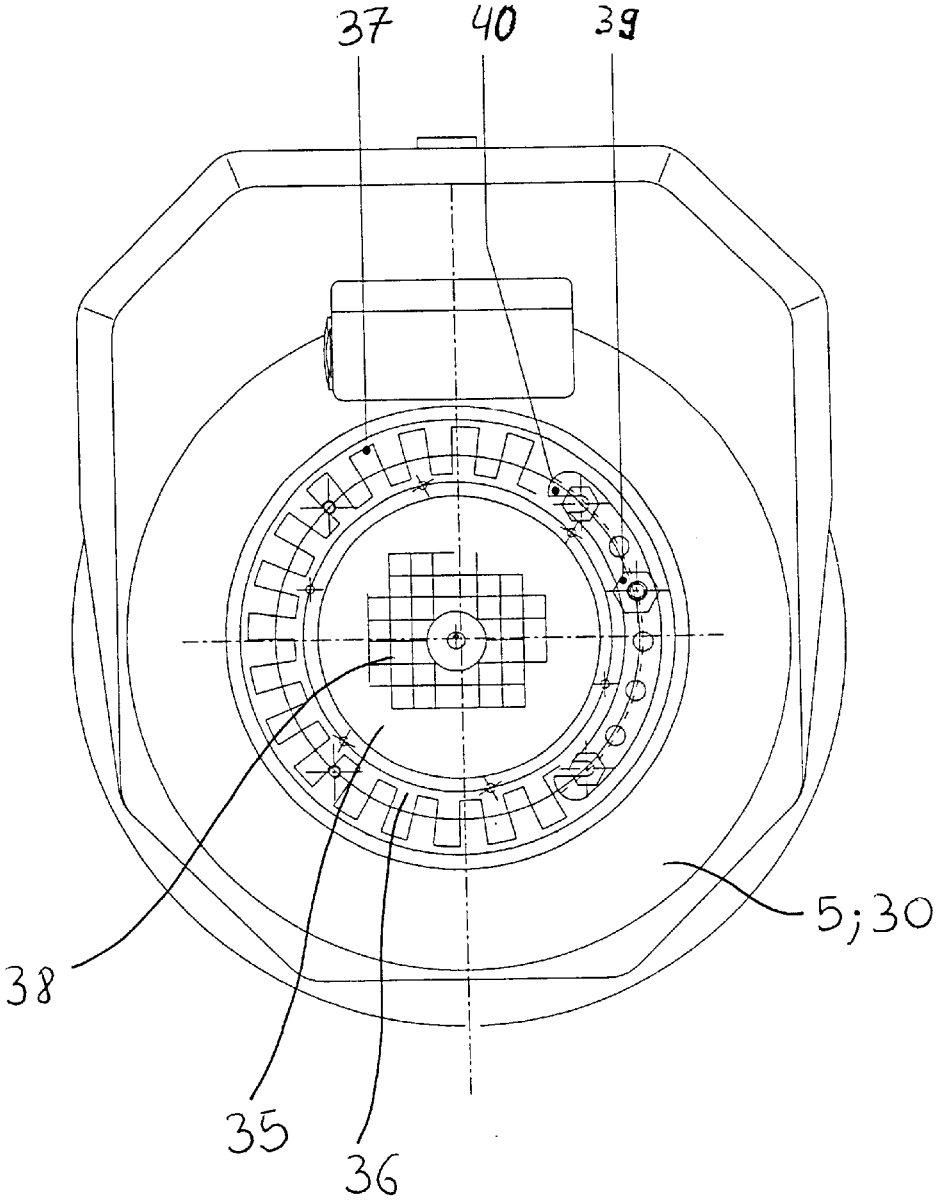

FIG. 2 shows a section B—B from FIG. 1 through a single-shaft chip breaker with the coarse-part ejecting element closed FIG. 3 shows a section B—B from FIG. 1 through a single-shaft chip breaker with the coarse-part ejecting element open FIG. 4 shows a plan view of a twin-shaft chip breaker with the coarse-part ejecting element closed FIG. 5 shows a section through a twin-shaft chip breaker with the coarse-part ejecting element closed and two shafts arranged at the same level FIG. 6 shows a section through a twin-shaft chip breaker with the coarse-part ejecting element closed and two shafts arranged at different levels FIG. 7 shows a view of an inclined twin-shaft chip breaker, the axis of rotation of the inclination being parallel to the axis of rotation of the shafts FIG. 8 shows a view of an inclined twin-shaft chip breaker, the axis of rotation of the inclination running perpendicularly in relation to the axes of rotation of the shafts FIG. 9 shows a schematic plan view of an electric drive.

Represented in FIG. 1 is a single-shaft chip breaker with a comminuting space 1 and an ejecting chamber 2. Arranged in the comminuting space 1 is a horizontal shearing shaft 3 with a multiplicity of shearing elements 4, which is driven by an electric drive 5 and is provided with a controller (not represented here). One of the shearing elements 4 is represented in detail, the others are represented schematically. The shearing elements 4 are individually screwed on the shearing shaft 3 at intervals from one another in rows, predominantly parallel to the axis of the shearing shaft. Each shearing element 4 may be equipped with one or more shearing cutters of extremely different designs. In the configuration in question here, the shearing element 4 is formed in one piece with a single shearing cutter 6. In this case, the shearing cutter 6 has been milled into the shearing element. The shearing cutter 6 lies predominantly transversely in relation to the shearing shaft axis.

Screwed on the wall 7 is a counter-shearing element in the form of a shearing row 8 with shearing teeth 9. The shearing row 8 is aligned above the shearing shaft axis with an inclination towards the shearing shaft axis. On the opposite wall 10, which is represented in FIGS. 2 and 3, a further shearing row 11 is screwed on at the level of the shearing shaft axis. It forms the lower limitation of an outwardly pivotable coarse-part ejecting element in the form of an ejecting flap 12. This shearing row 11 is attached with a downward inclination towards the ejecting chamber 2. When the shearing shaft 3 is rotating, the shearing cutters 6 of the shearing shaft 3 engage between the shearing teeth 9 of the two shearing rows 8, 11. The shearing teeth may be formed differently within a shearing row. For example, they may vary in shape, hardness and sharpness. Depending on how well the shearing cutters 6 engage in the regions between the shearing teeth 9, the shearing action to which the chips are subjected is replaced by a cutting action.

The ejecting flap 12 can be opened towards the ejecting chamber 2 by means of a lever device 13. It is closed during the normal comminuting operation. The controller (not represented here) of the ejecting flap 12 is linked with the controller of the shearing shaft 3. A concavely curved perforated screening plate 14 arranged underneath the shearing shaft 3 is not represented here. This perforated screening plate 14 is revealed in FIGS. 2 and 3.

If chips to be comminuted, for example metallic chips, are then introduced into the comminuting space 1 from above, they are taken up by the rotating shearing shaft 3, moved to the shearing row 8, comminuted between the shearing element 4 of the shearing shaft 3 and the shearing row 8 and carried towards the perforated screening plate 14. The chips which are already small enough fall through the perforated screening plate 14. Larger chips are subjected to a shearing action between the shearing shaft 3 and the perforated screening plate 14 and are partly discharged through the perforated screening plate 14 or taken along by the shearing shaft 3. Between the shearing row 11 and the shearing shaft 3, the chips taken along are comminuted once again and transported back to the starting point. There, these chips meet new, still uncomminuted chips and are transported with the latter once again to the first shearing row 8 and are in turn comminuted.

It often happens that the chips to be comminuted are mixed with coarse parts. These may be, for example, fragments of machined workpieces. If such a part then gets into the comminuting space 1 between the shearing shaft 3 and the shearing row 8, the shearing shaft 3 is immediately blocked. Compacted clumps of chips may also cause blocking of the shearing shaft 3, but the negative acceleration of the shearing shaft 3 produced in this case is less than in the case of coarse parts.

The negative acceleration of the shearing shaft 3 is sensed by the shearing-shaft controller, for example by means of rotational speed measurements at the electric drive 5. The parts of the apparatus for measuring the rotational speed are represented in FIG. 9. Depending on the intensity of the negative acceleration and depending on the type, size and quantity of chip, a programmed reversing and ejecting program begins. In this case, the rotational speed of the shearing shaft 3 during reversing is significantly reduced in comparison with the normal rotational speed.

For blockages due to dense clumps of chips, for example, a reversing operation of 20 reversing steps with the ejecting flap 12 closed is set. This number should be chosen to be high enough nevertheless to allow the compacted clumps of chips to be comminuted. If the predetermined number of reversing steps is exceeded, the ejecting flap 12 can be opened and any uncomminuted constituent which still happens to be present can be discharged beyond the once again reversing shearing shaft 3.

In the case of hard coarse parts, which during blockages cause a high negative acceleration of the shearing shaft 3, brief reversing of the shearing shaft 3, for example 3–4 times, is carried out with the ejecting flap 12 open. As a result, the coarse part can be segregated immediately. The ejecting flap 12 is subsequently closed again and the shearing shaft 3 resumes its normal direction and speed of rotation.

In FIGS. 2 and 3, a section B—B through the single-shaft chip breaker from FIG. 1 is respectively represented, with the ejecting flap 12 closed and open. Shearing elements 4, with a shearing cutter 6 in each case, are attached on the shearing shaft 3 at equal intervals. The shearing cutters may be formed with differing sharpness. Screwed on either side of the shearing shaft 3 there is in each case a shearing row 8, 11. The shearing teeth 9 of the shearing rows 8, 11 engage between the shearing cutters 6 of the shearing shaft 3. The shearing teeth 9 within a shearing row 8, 11 may be formed with differing sharpness. Arranged underneath the shearing shaft 3 is a concavely curved perforated screening plate 14. The shearing row 11 arranged lower down forms the lower limitation of the ejecting flap 12. This ejecting flap 12 can be pivoted away hydraulically or pneumatically by means of a lever device 13 (not represented here) into an ejecting space 2 and consequently opens a passage in the comminuting space wall 10.

Represented in FIGS. 4 and 5 are a plan view of and a section through a twin-shaft chip breaker with a comminuting space 15 and an ejecting chamber 16. Arranged horizontally at the same level in the comminuting space 15 are a shearing shaft 17 and a counter-shearing shaft 18. The shafts 17,18 are provided with a multiplicity of shearing elements 19, 19' in the form of shearing discs. The shearing discs may be formed differently in sharpness, hardness and shape. These shearing discs 19, 19' are arranged at intervals in rows on the respective shaft 17, 18 in such a way that the shearing discs 19 of the shearing shaft 17 can engage in the intermediate spaces between the shearing discs 19' of the counter-shearing shaft 18. The outer edge of each shearing disc 19, 19' is provided with at least one shearing tooth 20 or the like.

Arranged underneath the two shafts 17, 18 is a perforated screen 21. This comprises a perforated screening plate 22, concavely curved twice towards the underside of the shafts, a central web 23, two side walls 24, 25 and reinforcements. These individual parts are connected to one another in one piece by means of welds 26, 27. The perforated screen 21 is screwed via its side walls 24, 25 to the walls 28, 29 of the comminuting space 15.

The shafts 17, 18 are driven by an electric drive 30 and are provided with at least one controller—not represented here.

On the wall 28, a first perforated-plate side wall 24 is attached in such a way that its top face 31 lies above the shaft axes. On the opposite wall 29, which separates the comminuting space 15 from the ejecting chamber 16, there is a closed ejecting flap 32. The lower limitation of the ejection, which is formed by a top face 33 of the wall 29, is formed with an inclination towards the ejecting chamber 16. The edge of this top face 33 facing the comminuting space 15, i.e. the higher-lying edge of the top face 33, is located at the level of the shaft axes. The ejecting flap 32 can be opened towards the ejecting chamber 16 pneumatically or hydraulically by means of a lever device 34. It is closed during the normal comminuting operation. As already described with respect to the single-shaft chip breaker, it is also the case with the twin-shaft chip breaker that the controller of the ejecting flap 32 is linked with the controller of the shearing shaft 17. Neither of the controllers is represented here. It is also possible to link up perhaps a further controller, i.e. a controller of the counter-shearing shaft 18.

If chips to be comminuted, for example metallic chips, are then introduced into the comminuting space 15 from above, they are taken up by the shearing discs 19, 19' of the two rotating shafts, i.e. the shearing shaft 17 and the counter-shearing shaft 18, comminuted between them and carried towards the perforated screening plate 22. As this happens, the chips are subjected to a shearing or cutting action between the shearing discs 19, 19', depending on the arrangement of the latter. In general, the shearing discs 19, 19' are arranged in such a way that the chips are subjected to a cutting action. The chips which are already small enough fall directly through the perforated screening plate 22. Chips which are too large are subjected to a shearing action between the shearing discs 19, 19' of the respective shaft 17, 18 and the perforated screening plate 22 and are partly discharged via the perforated screening plate 22 or taken along by the shafts 17, 18 and transported back to the starting point of the comminution. These chips that are taken along are comminuted once again together with new chips by further rotations of the shafts 17, 18.

If a coarse part then gets between the two shafts 17, 18 in the comminuting space 15, a blockage of the shafts 17, 18 may occur. Coarse parts may be both hard fragments and also compacted clumps of chips. The negative acceleration of the shearing shaft 17 and/or of the counter-shearing shaft 18 is sensed for example by means of rotational speed measurements at the electric drive 30. The parts of the apparatus for measuring the rotational speed are represented in FIG. 9. Depending on the intensity of the negative acceleration and depending on the type, size and quantity of chip, a programmed reversing and ejecting program begins. In this case, both the shearing shaft that is further away from the ejecting flap 32 (here: shearing shaft 17) and the other shaft (here: counter-shearing shaft 18) reverse. It goes without saying that the shearing shaft 17 could also be arranged closer to the ejecting flap and the counter-shearing shaft 18 could be arranged further away from it. The reversing operations of the two shafts 17, 18 must be coordinated with each other in such a way that the coarse parts to be discharged are transported to the ejecting flap 32 as quickly as possible. It may be provided that one of the two shafts or both the shafts 17, 18 significantly reduce their rotational speed during this program sequence in comparison with the normal rotational speed.

If a hard coarse fragment then lies between the wall 28 and the shearing shaft 17, the fragment is taken up by the shearing shaft 17 and transported by means of the latter towards the counter-shearing shaft 18 if the said shearing shaft 17 is briefly rotated back and forth, for example 5–6 times. To facilitate this transporting operation, the first perforated-screen side wall 24 is attached on the wall 28 with a top face 31 above the axis of the shearing shaft and counter-shearing shaft. The coarse part transported to the counter-shearing shaft 18 is then gripped by the latter and transported to the ejecting flap 32 by reversing. The coarse part falls into the ejecting chamber 16 through this ejecting flap 32. Subsequently, the ejecting flap 32 is closed again and the shafts 17, 18 resume their normal direction and speed of rotation.

For blockages due to dense clumps of chips, for example, a reversing operation of 20 reversing steps with the ejecting flap 32 closed is set. This number should be chosen to be high enough nevertheless to allow compacted clumps of chips to be comminuted. If the predetermined number of reversing steps is exceeded, the ejecting flap 32 can be opened and any uncomminuted constituent which still happens to be present can be discharged beyond the once again reversing shafts 17, 18.

In the case of a further possible embodiment of a twin-shaft chip breaker according to FIGS. 4 and 5, which is not explicitly presented here, it is provided that a further ejecting flap is attached to the wall 28 lying opposite the ejecting flap 32; in this case, the first perforated-screen side wall 24 is to be formed in a correspondingly shortened manner. An embodiment of this type allows coarse parts to be discharged by being transported by means of only one of the shafts 17 or 18. It is consequently possible to dispense with an exact coordination of the reversing movements of the two shafts.

FIG. 6 shows an embodiment of the twin-shaft chip breaker according to the invention that is slightly modified in comparison with FIGS. 4 and 5. In this case, the shearing shaft which is further away from the ejecting flap 32 (here: shearing shaft 17) is arranged higher than the counter-shearing shaft 18. Such a higher arrangement of the shearing shaft 17 facilitates the transporting of a coarse part towards the ejecting chamber 16.

FIGS. 7 and 8 show a twin-shaft chip breaker according to the invention in an inclined form. In this case, the axis of rotation of the inclination is formed on the one hand parallel to and on the other hand perpendicular to the axes of rotation of the shafts 17, 18. With an inclination by an angle $\alpha$ towards the coarse-part ejecting chamber 16, the discharge of coarse parts or compacted clumps of chips through the ejecting flap 32 is facilitated. An inclination of the apparatus by an angle $\beta$ towards the ends of the shafts close to the drive 30 has the effect that the material to be comminuted is moved towards the lower-lying ends of the shafts 17, 18. There, shearing discs 19, 19' of greater sharpness, which can chop up clumps of chips which are particularly difficult to comminute, may be provided. Of course, the two inclinations may be combined and varied in their extent. An inclined construction of this type is also conceivable for single-shaft chip breakers.

FIG. 9 shows an electric drive 5 or 30, on the motor shaft 35 of which a flat rotor 36 is attached. This rotor 36 has on its outer edge a multiplicity of rotor teeth 37, which are arranged at equal intervals in relation to one another. The rotor 36 is not represented in its entirety in the figure. Indicated above the rotor 36 is a lightweight metal fan 38. Statically fastened on a mount 40 underneath the rotor teeth 37 is a proximity switch in the form of a signal pickup 39. This signal pickup 39 may be an optical sensor.

If the motor shaft 35 rotates, the rotor 36 is also moved along with it. The signal pickup 39 senses the number of rotor teeth 37 moved past it. The respective negative accelerations of the motor shaft 35 are transmitted with help of the signal pickup 39 to the controllers (not represented here) of the shearing shaft(s) 3 or 17, 18 and ejecting flap(s) 12 or 32, so that, depending on the acceleration category, a defined program comprising reversing operations and possibly opening of the ejecting flap(s) 12 or 32 is executed.

| List of reference numerals | |
|---|---|
| 1 | Comminuting space |
| 2 | Ejecting chamber |
| 3 | Shearing shaft |
| 4 | Shearing element |
| 5 | Electric drive |
| 6 | Shearing cutter |
| 7 | Wall |
| 8 | Higher shearing row |
| 9 | Shearing teeth |
| 10 | Wall with ejecting flap |
| 11 | Lower shearing row |
| 12 | Ejecting flap |
| 13 | Lever device |
| 14 | Perforated screening plate |
| 15 | Comminuting space |
| 16 | Ejecting chamber |
| 17 | Shearing shaft |
| 18 | Counter-shearing shaft |
| 19 | Shearing disc on shearing shaft 17 |
| 19' | Shearing disc on counter-shearing shaft 18 |
| 20 | Shearing teeth |
| 21 | Perforated screen |
| 22 | Perforated screening plate |
| 23 | Central web |
| 24 | 1st perforated-screen side wall |
| 25 | 2nd perforated-screen side wall |
| 26 | Weld |
| 27 | Weld |
| 28 | Wall |
| 29 | Wall underneath the ejecting flap |
| 30 | Electric drive |
| 31 | Top face of the 1st perforated-screen side wall 24 |
| 32 | Ejecting flap |
| 33 | Top face of the wall 29 |
| 34 | Lever device |
| 35 | Motor shaft |
| 36 | Rotor (signal disc in rotor form) |
| 37 | Rotor teeth |
| 38 | Lightweight metal fan |
| 39 | Signal pickup (proximity switch) |
| 40 | Mount |

What is claimed is:

1. Method for comminuting chips in a comminuting space between a driven horizontal shaft, which can be rotated in both directions and is fitted with shearing elements, and assigned counter-shearing elements, with chips introduced from above being comminuted and discharged downwards via a perforated screening plate and blocking constituents, which cause the shaft to come to a standstill, being segregated after reversing the shaft, characterized in that the rate of change of the loading of the driven shaft, fitted with shearing elements, is sensed, in that the presence of blocking constituents is established on the basis of the sensed rate of change of the loading while taking into account the type, quantity and/or size of chip, in that then the non-comminuted blocking constituents are ejected after one or more reversals of the shaft, in that the acceleration of the shaft is sensed to sense the rate of change of the loading of the driven shaft fitted with shearing elements, and in that, on the basis of the established acceleration profile, the constituents causing a blockage are subdivided into at least two categories, the constituents being moved more or less frequently by reversing of the shaft, and either passed on in a comminuted state or thrown back in an uncomminuted state, according to the relevant category.

2. Method according to claim 1, characterized in that the categories are arranged according to increasing negative acceleration and the frequency of reversal decreases from category to category with increasing negative acceleration.

3. Method according to claim 2, characterized in that the change in rotational speed of the drive is measured for sensing a negative shaft acceleration.

4. Method according to claim 1, characterized in that the change in rotational speed of the drive is measured for sensing a negative shaft acceleration.

5. Apparatus for comminuting chips, the apparatus comprising a driven horizontal shaft which can be rotated in both directions by means of a drive and controller and is fitted with shearing elements, counter-shearing elements assigned to the shaft, and a curved perforated screening plate adapted to the shape of the shaft, the chips being comminuted in a comminuting space between the horizontal shaft and the counter-shearing elements, with chips introduced from above being comminuted and discharged downwards via the perforated screening plate and blocking constituents, which causes the shaft to come to a standstill, being segregated after reversing the shaft, characterized in that an openable coarse-part ejecting element is attached to at least one wall of the comminuting space lying parallel to the shaft axis, in that the counter-shearing elements are arranged in two rows on walls of the comminuting space lying parallel to the shaft axis, in that a controller for the coarse-part ejecting element is provided, in that the controllers of the shaft and coarse-part ejecting element are linked with each other, in that, for sensing the rate of change of the loading of the shaft, a controller for the coarse-part ejecting element is provided, sensing the negative accelerations of the shaft, the presence of blocking constituents being established on the basis of the sensed rate of change of the loading while taking into account the type, quantity and/or size of chip, the non-comminuted blocking constituents being ejected after one or more reversals of the shaft, and in that, depending on the respective negative acceleration, a variable number of reversing operations with the coarse-part ejecting element closed and/or open can be programmed, the constituents causing a blockage being subdivided into at least two categories, the constituents being moved more or less frequently by reversing of the shaft, and either passed on in a comminuted state or thrown back in an uncomminuted state, according to the relevant category.

6. Apparatus according to claim 5, characterized in that an electric motor is provided as the drive and further characterized in that a pulse pickup for measuring the rotational speed at the electric motor is provided for sensing the negative shaft acceleration.

7. Apparatus according to claim 5, characterized in that an electric motor is provided as the drive and further characterized in that the increase in current at the electric motor is to be measured for sensing the negative shaft acceleration.

8. Apparatus for comminuting chips, the apparatus comprising a driven horizontal shaft which can be rotated in both directions by means of a drive and controller and is fitted with shearing elements, counter-shearing elements arranged on an assigned countershaft of the same kind, and a perforated screening plate curved to match the shaft and the countershaft, the chips being comminuted in a comminuting space between the horizontal shaft and the counter-shearing elements, with chips introduced from above being comminuted and discharged downwards via the perforated screening plate and blocking constituents, which causes the shaft to come to a standstill, being segregated after reversing the shaft, characterized in that an openable coarse-part ejecting element is attached to at least one wall of the comminuting space lying parallel to the shaft axis, in that a controller for the coarse-part ejecting element, sensing the negative accelerations of at least one of the shafts, is provided for sensing the rate of change of the loading of the driven shaft(s), the presence of blocking constituents being established on the basis of the sensed rate of change of the loading while taking into account the type, quantity and/or size of chip, the non-comminuted blocking constituents being ejected after one or more reversals of the shaft, in that the controllers of the shaft, countershaft and coarse-part ejecting element are linked with each other, and in that, depending on the respective negative acceleration, a variable number of reversing operations with the coarse-part ejecting element closed and/or open can be programmed, the constituents causing a blockage being subdivided into at least two categories, the constituents being moved more or less frequently by reversing of the shaft, and either passed on in a comminuted state or thrown back in an uncomminuted state, according to the relevant category.

9. Apparatus according to claim 8, characterized in that an electric motor is provided as the drive and further characterized in that a pulse pickup for measuring the rotational speed at the electric motor is provided for sensing the negative shaft acceleration.

10. Apparatus according to claim 8, characterized in that an electric motor is provided as the drive and further characterized in that the increase in current at the electric motor is to be measured for sensing the negative shaft acceleration.

11. Apparatus for comminuting material that is introduced from above, comminuted, and discharged downwards, comprising:

a. a single, horizontal shearing shaft, the shaft having a plurality of shearing elements, being capable of being rotated about a shaft axis in either direction by a drive via a drive controller, and positioned horizontally in a comminuting space;

b. at least one fixed set of counter-shearing elements cooperating with the plurality of shearing elements of the shearing shaft to comminute the material; and c. at least one movable door, the door being free of counter-shearing elements and movable by an actuator via an actuator controller between at least (i) an open position in which coarse material can be ejected from the comminuting space through an opening by the drive controller causing the drive to rotate the single, horizontal shearing shaft in a direction that moves the coarse material toward and through the opening and (ii) a closed position in which the door blocks the opening, wherein the opening permits coarse material to be ejected to a different location than the comminuted material that is discharged downwards; and d. wherein the drive controller and actuator controller are linked and cooperate to eject coarse material by (i) the actuator controller causing the actuator to move the door to the open position, (ii) the drive controller causing the drive to rotate the single, horizontal shearing shaft in a direction that moves the coarse material toward and through the opening, (iii) the actuator controller causing the actuator to move the door to the closed position, and (iv) the drive controller causing the drive to rotate the single, horizontal shearing shaft in a direction that comminutes material.

12. Apparatus for comminuting material according to claim 11 wherein at least one fixed set of counter-shearing elements is positioned on one side of the single, horizontal shearing shaft relative to an imaginary vertical plane passing through the shaft axis, and the movable door in the closed position is positioned on the opposite side of the single, horizontal shearing shaft as the at least one fixed set of counter-shearing elements relative to the imaginary vertical plane passing through the shaft axis.

13. Apparatus for comminuting material that is introduced from above, comminuted, and discharged downwards, comprising:

a. a single, horizontal shearing shaft, the shaft having a plurality of shearing elements, being capable of being rotated about a shaft axis in either direction by a drive via a drive controller, and positioned horizontally in a comminuting space, the drive controller causing the drive to rotate the shearing shaft in a first direction to comminute the material;

b. at least one fixed set of counter-shearing elements cooperating with the plurality of shearing elements of the shearing shaft to comminute material, wherein at least one fixed set of counter-shearing elements is positioned on one side of the single, horizontal shearing shaft relative to an imaginary vertical plane passing through the shaft axis;

c. a curved screen positioned proximate to and beneath the single, horizontal shearing shaft, and through which comminuted material is discharged downwards; and d. at least one movable door, the door being free of counter-shearing elements and movable by an actuator via an actuator controller between at least (i) an open position in which coarse material can be ejected from the comminuting space through an opening by the drive controller causing the drive to rotate the single, horizontal shearing shaft in a second, reverse direction that moves the coarse material toward and through the opening and (ii) a closed position in which the door blocks the opening, wherein the movable door in the closed position is positioned on the opposite side of the single, horizontal shearing shaft as the at least one fixed set of counter-shearing elements relative to the imaginary vertical plane passing through the shaft axis, and wherein the opening permits coarse material to be ejected to a different location than the comminuted material that is discharged downwards; and e. wherein the drive controller and actuator controller are linked and cooperate to eject coarse material by (i) the actuator controller causing the actuator to move the door to the open position, (ii) the drive controller causing the drive to rotate the single, horizontal shearing shaft in the second, reverse direction that moves the coarse material toward and through the opening, (iii)

the actuator controller causing the actuator to move the door to the closed position, and (iv) the drive controller causing the drive to rotate the single, horizontal shearing shaft in the first direction that comminutes material.

14. Apparatus for comminuting material that is introduced from above, comminuted, and discharged downwards, comprising:

a. a single, horizontal shearing shaft, the shaft having a plurality of shearing elements individually fastened to the shaft, the shaft being capable of being rotated about a shaft axis in either direction by a drive via a drive controller, the drive controller causing the drive to rotate the shearing shaft in a first direction to comminute the material, and the shaft positioned horizontally in a comminuting space formed at least in part by first and second walls;

b. at least one fixed set of counter-shearing elements mounted to one of the walls parallel to the shaft axis and cooperating with the plurality of shearing elements of the shearing shaft to comminute material, wherein at least one fixed set of counter-shearing elements is positioned on one side of the single, horizontal shearing shaft relative to an imaginary vertical plane passing through the shaft axis;

c. a curved screen positioned proximate to and beneath the single, horizontal shearing shaft, and through which comminuted material is discharged downwards; and d. at least one movable door, the door being free of counter-shearing elements and movable by an actuator via an actuator controller between at least (i) an open position in which coarse material can be ejected from the comminuting space through an opening by the drive controller causing the drive to rotate the single, horizontal shearing shaft in a second, reverse direction that moves the coarse material toward and through the opening, the opening being positioned above one of the walls, and (ii) a closed position in which the door blocks the opening, wherein the movable door in the closed position is positioned on the opposite side of the single, horizontal shearing shaft as the at least one fixed set of counter-shearing elements relative to the imaginary vertical plane passing through the shaft axis, and wherein the opening permits coarse material to be ejected to a different location than the comminuted material that is discharged downwards; and e. wherein the drive controller and actuator controller are linked and cooperate to eject coarse material by (i) the actuator controller causing the actuator to move the door to the open position, (ii) the drive controller causing the drive to rotate the single, horizontal shearing shaft in the second, reverse direction that moves the coarse material toward and through the opening, (iii) the actuator controller causing the actuator to move the door to the closed position, and (iv) the drive controller causing the drive to rotate the single, horizontal shearing shaft in the first direction that comminutes material.

15. Apparatus for comminuting material according to any of claims 11 or 13 or 14 wherein the movable door pivots between the open and closed positions.

16. Apparatus for comminuting material according to any of claims 11 or 13 or 14 wherein the movable door slides between the open and closed positions.

17. Apparatus for comminuting material according to any of claims 11 or 13 or 14 wherein the actuator comprises a hydraulically pivoted lever controlled by the actuator controller.

18. Apparatus for comminuting material according to any of claims 11 or 13 or 14 wherein the actuator comprises a pneumatically pivoted lever controlled by the actuator controller.

19. Apparatus for comminuting material according to any of claims 11 or 13 or 14 or 12 wherein at least one fixed set of counter-shearing elements is positioned relative to the plurality of shearing elements of the shearing shaft to comminute metallic chips, which are introduced from above, comminuted, and discharged downwards.

20. Apparatus for comminuting material according to any of claims 13 or 14 or 12 wherein the at least one fixed set of counter-shearing elements positioned on the one side of the single, horizontal shearing shaft is positioned higher than an imaginary horizontal plane passing through the shaft axis.

21. Apparatus for comminuting material according to any of claims 13 or 14 or 12 further comprising a second fixed set of counter-shearing elements cooperating with the plurality of shearing elements of the shearing shaft to comminute material and positioned on the same side of the single, horizontal shearing shaft as the movable door when the movable door is in the closed position.

22. Apparatus for comminuting material according to claim 21 wherein (a) the at least one fixed set of counter-shearing elements that is positioned on the one side of the single, horizontal shearing shaft is also positioned higher than an imaginary horizontal plane passing through the shaft axis and (b) the second fixed set of counter-shearing elements that is positioned on the same side of the single, horizontal shearing shaft as the movable door is also positioned at or below the imaginary horizontal plane passing through the shaft axis.

23. Apparatus for comminuting material according to claim 22 wherein the second fixed set of counter-shearing elements is positioned adjacent an edge of the movable door when the movable door is in the closed position.

24. Apparatus for comminuting material according to claim 21 wherein the second fixed set of counter-shearing elements is positioned adjacent an edge of the movable door when the movable door is in the closed position.

* * * * *